US010758942B2

(12) United States Patent
Galloway McLean

(10) Patent No.: US 10,758,942 B2
(45) Date of Patent: Sep. 1, 2020

(54) CLIP AND SEAL ASSEMBLY

(71) Applicant: M-I DRILLING FLUIDS UK LTD, Aberdeen (GB)

(72) Inventor: Claire Rosaleen Galloway McLean, East Lothian (GB)

(73) Assignee: M-I DRILLING FLUIDS UK LTD, Aberdeen (GB)

( * ) Notice: Subject to any disclaimer, the term of this patent is extended or adjusted under 35 U.S.C. 154(b) by 0 days.

(21) Appl. No.: 15/760,191

(22) PCT Filed: Sep. 13, 2016

(86) PCT No.: PCT/US2016/051437

§ 371 (c)(1),
(2) Date: Mar. 14, 2018

(87) PCT Pub. No.: WO2017/048672

PCT Pub. Date: Mar. 23, 2017

(65) Prior Publication Data

US 2018/0250712 A1 Sep. 6, 2018

Related U.S. Application Data

(60) Provisional application No. 62/218,535, filed on Sep. 14, 2015.

(51) Int. Cl.

| | |
|---|---|
| ***B07B 1/46*** | (2006.01) |
| ***B07B 13/04*** | (2006.01) |
| *B07B 1/36* | (2006.01) |

(52) U.S. Cl.

CPC ..... *B07B 1/4663* (2013.01); *B07B 1/4609* (2013.01); *B07B 1/4645* (2013.01); *B07B 13/04* (2013.01); *B07B 1/36* (2013.01)

(58) Field of Classification Search

CPC ..... B07B 1/4645; B07B 1/4663; B07B 1/36

(Continued)

(56) References Cited

U.S. PATENT DOCUMENTS

| | | | |
|---|---|---|---|
| 4,237,000 A | 12/1980 | Read et al. | |
| 4,728,422 A | 3/1988 | Bailey | |

(Continued)

FOREIGN PATENT DOCUMENTS

| | | | | |
|---|---|---|---|---|
| GB | 2461726 A * | 1/2010 | ..... | B07B 1/4663 |
| WO | 2000/25890 A1 | 5/2000 | | |

(Continued)

OTHER PUBLICATIONS

International Search Report and Written Opinion for the cross referenced International patent application PCT/US2014/069202 dated Mar. 26, 2015.

(Continued)

*Primary Examiner* — Terrell H Matthews
(74) *Attorney, Agent, or Firm* — Jeffrey D. Frantz

(57) ABSTRACT

An apparatus having a screen frame with a first screening surface and multiple openings is disclosed. The openings can be bounded by at least one mating surface. One or more screen filter unit having a second screening surface can be disposed in one of the openings of the screen frame. The one or more screen filter unit can have one or more sealing surface that can be coupled to the at least one mating surface of the screen frame.

9 Claims, 10 Drawing Sheets

(58) Field of Classification Search
USPC ..... 209/319
See application file for complete search history.

(56) References Cited

U.S. PATENT DOCUMENTS

| | | | | |
|---|---|---|---|---|
| 5,049,262 | A | 9/1991 | Galton et al. | |
| 5,137,622 | A | 8/1992 | Souter | |
| 5,221,008 | A | 6/1993 | Derrick, Jr. et al. | |
| 5,690,826 | A | 11/1997 | Cravello | |
| 5,720,881 | A | 2/1998 | Derrick et al. | |
| 5,816,413 | A | 10/1998 | Boccabella et al. | |
| 5,958,236 | A | 9/1999 | Bakula | |
| 6,029,824 | A | 2/2000 | Adam | |
| 6,269,953 | B1 | 8/2001 | Seyffert et al. | |
| 6,443,310 | B1 | 9/2002 | Schulte, Jr. | |
| 6,675,975 | B1 | 1/2004 | Cook et al. | |
| 7,011,218 | B2 | 3/2006 | Colgrove et al. | |
| 7,896,162 | B2 | 3/2011 | Bailey | |
| 9,744,564 | B2 * | 8/2017 | Cady | B01D 33/0376 |
| 10,259,012 | B2 * | 4/2019 | Robertson | B07B 1/4663 |
| 10,307,794 | B2 * | 6/2019 | Marshall | B07B 1/469 |
| 2004/0074821 | A1 | 4/2004 | Russell et al. | |
| 2004/0099578 | A1 | 5/2004 | Winkler et al. | |
| 2005/0000865 | A1 | 1/2005 | Schulte et al. | |
| 2007/0108107 | A1 | 5/2007 | Morrow | |
| 2008/0078702 | A1 * | 4/2008 | Carr | B07B 1/46 209/326 |
| 2008/0078704 | A1 * | 4/2008 | Carr | B07B 1/48 209/399 |
| 2008/0314804 | A1 | 12/2008 | Wojciechowski et al. | |
| 2010/0276343 | A1 | 11/2010 | Hukki | |
| 2011/0094950 | A1 * | 4/2011 | Dahl | B07B 1/4618 210/85 |
| 2011/0253602 | A1 | 10/2011 | Lipa et al. | |
| 2014/0183143 | A1 | 7/2014 | Cady et al. | |
| 2015/0158054 | A1 | 6/2015 | Cady | |

FOREIGN PATENT DOCUMENTS

| | | | |
|---|---|---|---|
| WO | 2005/077551 | A1 | 8/2005 |
| WO | 2008/077181 | A1 | 7/2008 |
| WO | 2013/188322 | A2 | 12/2013 |
| WO | 2013/188451 | A1 | 12/2013 |
| WO | 2016/077432 | A1 | 5/2016 |

OTHER PUBLICATIONS

Extended Search Report for European patent application 13803459.0 dated Jan. 7, 2016 filed as IDS for the cross referenced U.S. Appl. No. 14/102,237.

Office Action for Canadian patent application 2876340 dated Jan. 14, 2016 filed as IDS for the cross referenced U.S. Appl. No. 14/102,237.

International Search Report and Written Opinion for the equivalent International patent application PCT/US2016/051437 dated Dec. 17, 2016.

International Preliminary Report on Patentability for the equivalent International patent application PCT/US2016/051437 dated Mar. 29, 2018.

* cited by examiner

CLIP AND SEAL ASSEMBLY

CROSS-REFERENCE TO RELATED APPLICATION

The present document is based on and claims priority to U.S. Provisional Application Ser. No. 62/218,535, filed Sep. 14, 2015, which is incorporated herein by reference in its entirety.

BACKGROUND

Vibratory separators are used to separate solid particulates of different sizes and/or to separate solid particulate from fluids. Various industries use vibratory separators for filtering materials, for example, the oil and gas industry, the food processing industry, the pharmaceutical industry, and the agriculture industry. A vibratory separator is a vibrating sieve-like table upon which solids-laden fluid is deposited and through which clean fluid emerges. The vibratory separator may be a table with a generally perforated filter screen bottom. Fluid is deposited at the feed end of the vibratory separator. As the fluid travels down the length of the vibrating table, the fluid falls through the perforations to a reservoir below, leaving the solid particulate material behind. The vibrating action of the vibratory separator table conveys solid particles left behind to a discharge end of the separator table.

The vibratory shaker includes a screen disposed within a basket of the vibratory separator. The screens themselves may be flat or nearly flat, corrugated, depressed, or contain raised surfaces. Due to the vibration or shaking of the vibratory separator, and the materials processed through the vibratory separator, the screens, as well as other parts, in the separator may wear over time. Therefore, screens are removably secured in the basket so they can be removed for repair or replacement.

The above described apparatus is illustrative of one type of shaker or vibratory separator known to those of ordinary skill in the art.

DETAILED DESCRIPTION

Figure 1:
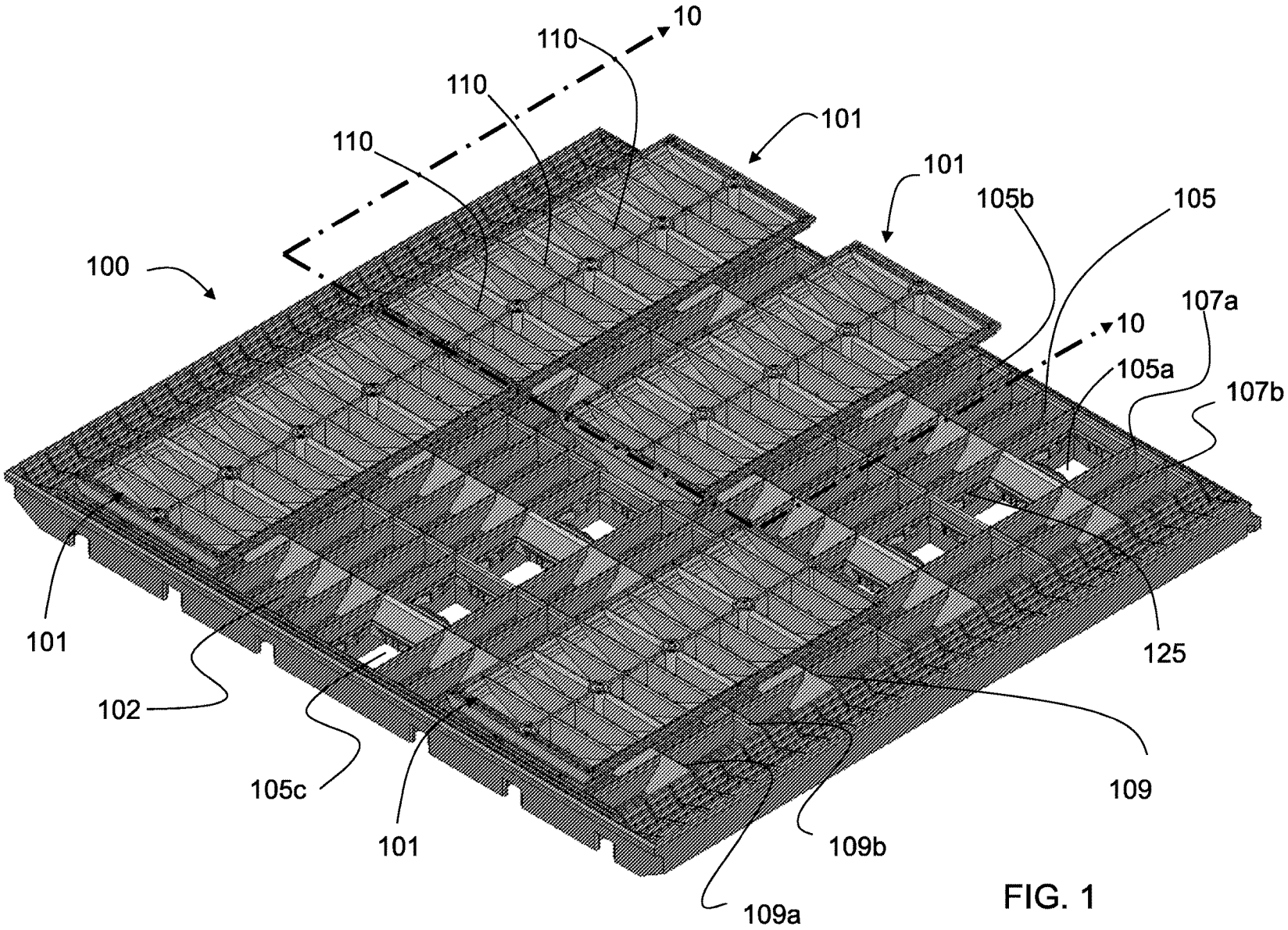
FIG. 1 shows a perspective view of a screen frame with a plurality of screen inserts installed in accordance with one or more embodiments of the present disclosure.

The following is directed to various examples of embodiments of the disclosure. The embodiments disclosed should not be interpreted, or otherwise used, as limiting the scope of the disclosure, including the claims. In addition, those having ordinary skill in the art will appreciate that the following description has broad application, and the discussion of any embodiment is meant only to be an example of that embodiment, and not intended to suggest that the scope of the disclosure, including the claims, is limited to that embodiment. Specifically, while embodiments disclosed herein may reference shale shakers or vibratory separators used to separate cuttings from drilling fluids in oil and gas applications, one of ordinary skill in the art will appreciate that a vibratory separator (or vibratory shaker) and its component parts as disclosed herein and methods disclosed herein may be used in any industrial application. For example, vibratory separators in accordance with embodiments disclosed herein may be used in the food industry, cleaning industry, waste water treatment, and others.

Certain terms are used throughout the following description and the claims refer to particular features or components. As those having ordinary skill in the art will appreciate, different persons may refer to the same feature or component by different names. This document does not intend to distinguish between components or features that differ in name but not function. The figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component is coupled to a second component, that connection may be through a direct connection, or through an indirect connection via other components, devices, and connections. Additionally, directional terms, such as "above," "below," "upper," "lower," etc., are used for convenience in referring to the accompanying drawings.

Embodiments disclosed herein relate generally to vibratory separators, and in particular, to vibratory separators having one or more high capacity screen assemblies. High capacity screen assemblies may be used to increase or maximize the amount of fluid capacity of a vibratory separator (e.g., the number of gallons per minute of drilling fluid or mud that a vibratory separator can process). The higher fluid capacity a vibratory separator has, the fewer separators and screens may be used to maintain drilling operations. High capacity sifting or filtering screens are designed to maximize the flow rate of drilling fluids which may be processed and include an assembly of parts which involve additional manufacturing and assembly processes.

High capacity screen assemblies may include, for example, a modified single screen that provides higher effective processing capacity than a standard or conventional single screen. For example, a high capacity screen assembly may include a screen frame having a first screening surface disposed above a second screening surface. In other words, a single screen frame includes a two-tier screening surface. The two-tier screening surface may be integrally formed with the screen frame or one or both of the two tiers of the screening surface may be coupled to the screen frame. In some embodiments, the first screening surface may be coupled to the second screening surface or may be coupled to the screen frame.

In some embodiments, a high capacity screening assembly may include one or more screen inserts installed into a screen frame. For example, a screen frame may include a screen surface having a plurality of openings, and a screen insert disposed in a first opening of the plurality of openings of the screen frame. A single screen frame or deck having two screening surfaces (i.e., two-tier screening surface), may provide a larger screening surface area than the screening surface area of the screen frame alone and/or may provide double screening of a material within a single screen frame when the two screening surfaces of the single screen frame are positioned in series so that fluid passes through two screening surface of the screen frame. Examples of two-tier screening assemblies are shown and described in WO 2013/188322, assigned to the assignee of the present application, and incorporated by reference in its entirety.

Embodiments of the present disclosure provide a screen frame with a mating or sealing surface configured to engage a screen insert inserted into an opening of the screen frame. Embodiments of the present disclosure also provide a screen insert with a mating or sealing surface configured to engage one or more longitudinal or transverse ribs of a screen frame when the screen insert is inserted in an opening of the screen frame. The mating and/or sealing surfaces of the screen frame and/or screen insert may be configured to reduce or prevent leaks between the screen insert and the screen frame in accordance with embodiments disclosed herein.

The mating face may be provided between the screen frame and the insert. In some embodiments, a gasket may be installed to provide a seal between the insert and the screen frame. To alleviate the need for a gasket to provide a satisfactory seal, the mating face may be moved from a top mesh surface of the screen frame to a lower sealing surface of the screen frame. The mating face may taper to a point which creates a convoluted path, making it likely that solids that find the path will pack out and create a filter cake, blocking unwanted particles from passing through.

To increase the flow rate of wellbore fluid through a screen frame, a screen frame insert is inserted into an opening of the screen frame. The screen frame insert increases the surface area of the screen frame, by providing another screening surface for the wellbore fluid. The openings of the screen are formed by the intersection of a plurality of longitudinal ribs and a plurality of transverse ribs. In some embodiments, a mating surface may be located on a longitudinal rib or may be located on a transverse rib. In other embodiments, the mating surface may be located on both longitudinal ribs and both transverse ribs, thus surrounding the opening. The mating surface may be located on any combination of a longitudinal rib and/or a transverse rib, such as could be designed by one of ordinary skill in the art.

In some embodiments, the screen frame insert may also include a plurality of openings formed by the intersection of a plurality of longitudinal ribs and a plurality of transverse ribs. In some embodiments, a sealing surface may be located on a longitudinal rib or may be located on a transverse rib. In other embodiments, the sealing surface may be located on both longitudinal ribs and both transverse ribs, thus surrounding the opening. The sealing surface may be located on any combination of a longitudinal rib and/or a transverse rib, such as could be designed by one of ordinary skill in the art. In some embodiments, the sealing surface of the screen frame insert corresponds to the mating surface of the screen frame. In some embodiments, the sealing surface of the screen frame insert corresponds to the mating surface of the screen frame.

By having mating surfaces and sealing surfaces which correspond, insertion of the screen frame insert into the screen frame may be assisted. The corresponding mating surfaces and sealing surfaces may also aid in blocking unwanted particles passing through. After inserting the screen frame insert into the opening of the screen frame and aligning the corresponding mating surfaces and sealing surfaces, a tortuous path makes it likely that any solids finding the path would create a filter cake. To ensure the screen frame insert is "seated" onto the screen frame, force may be applied, such that the corresponding mating surfaces and sealing surfaces form a seal.

In yet other embodiments, the screen frame insert may include an extending member which may engage with at least one of the longitudinal ribs and/or the transverse ribs of the screen frame. In some embodiments, the screen frame insert may engage the screen frame via one or more clips located on the extending member. In other embodiments, the longitudinal ribs and/or the transverse ribs of the screen frame may include a plurality of teeth which engage with the extending member of the screen frame insert. Embodiments of the screen frame and screen frame insert are described below.

Figure 2:
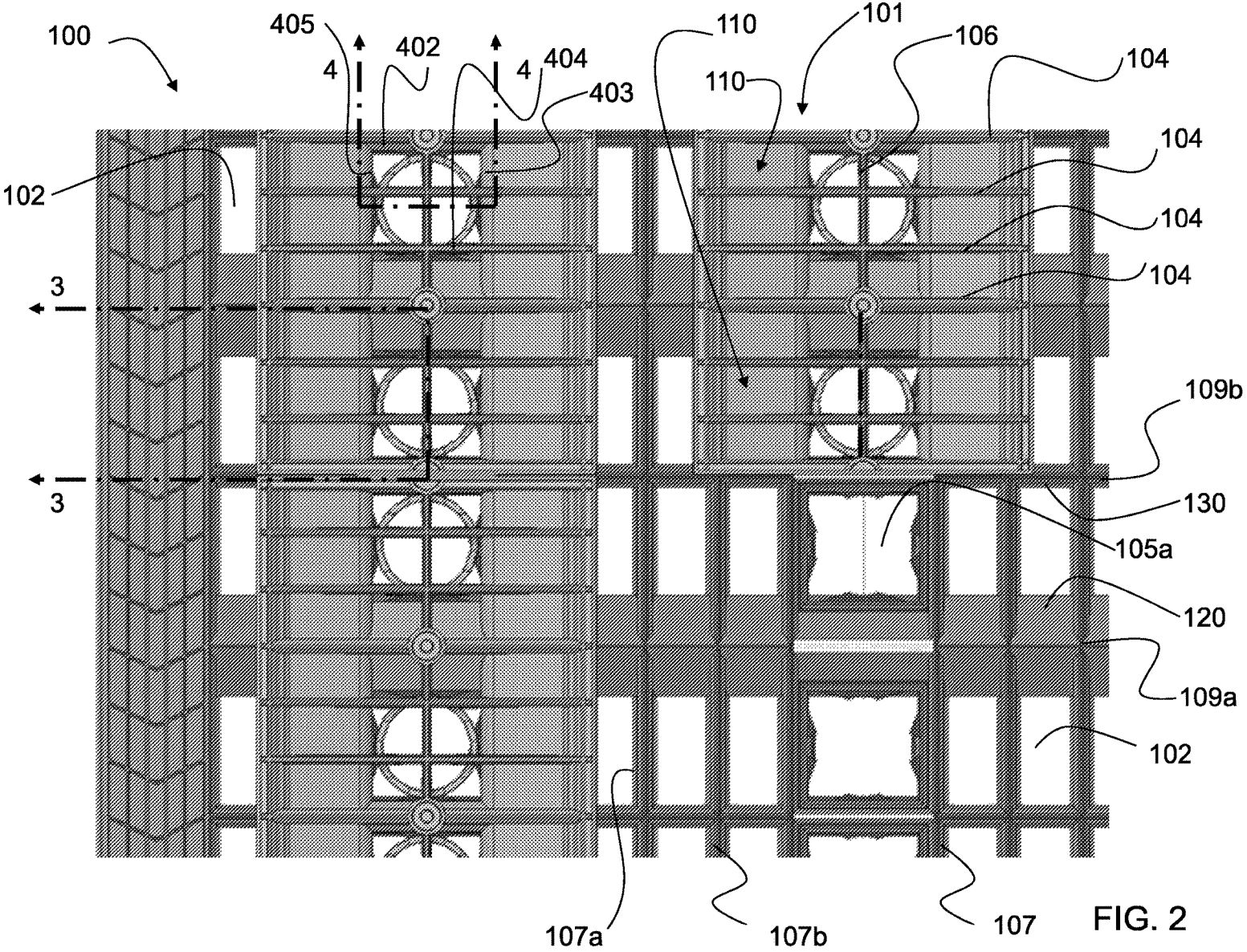
FIG. 2 shows a top view of a portion of a screen frame with a plurality of screen inserts installed in accordance with one or more embodiments of the present disclosure.
Figure 3:
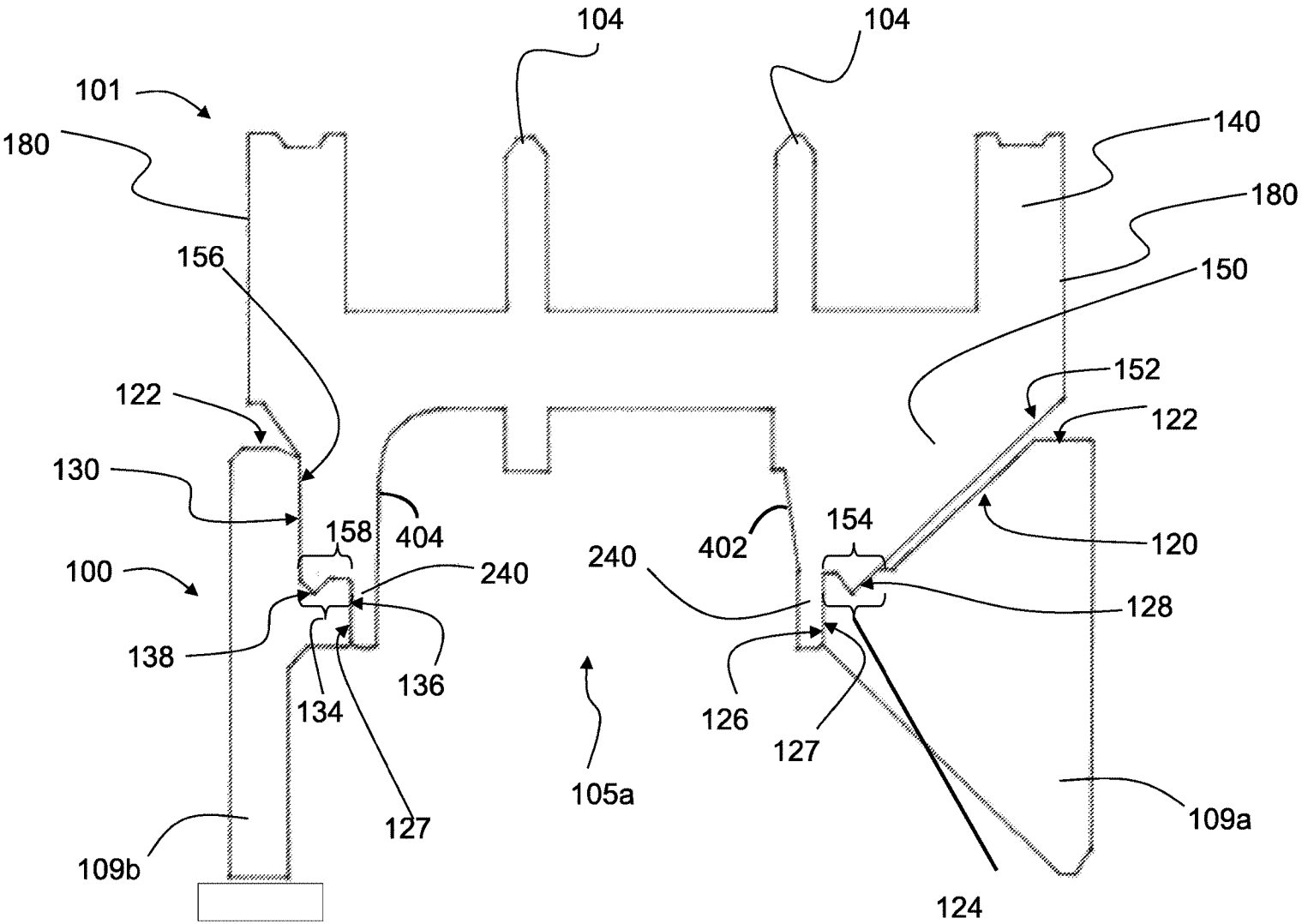
FIG. 3, taken along lines 3-3 of FIG. 2, shows a cross-sectional side view from a longitudinal side of a portion of a screen frame with a screen insert installed in accordance with one or more embodiments of the present disclosure.

Referring to FIGS. 1-3, a perspective view, a top view, and a cross-sectional side view of an example of a high capacity screen assembly in accordance with embodiments of the present disclosure are shown, respectively. In this embodiment, a screen frame 100 having a plurality of screen insert units 101 disposed therein is shown. The screen frame 100 is configured to be installed in a vibratory separator frame (not shown) as will be understood by one of ordinary skill in the art. The screen frame 100 may be a composite screen frame; however, one of ordinary skill in the art will appreciate that other types of screen frames may be used without departing from the scope of embodiments disclosed herein. The screen frame 100 is formed having a plurality of transverse ribs 107 and a plurality of longitudinal ribs 109 defining a plurality of openings 105.

Figure 9:
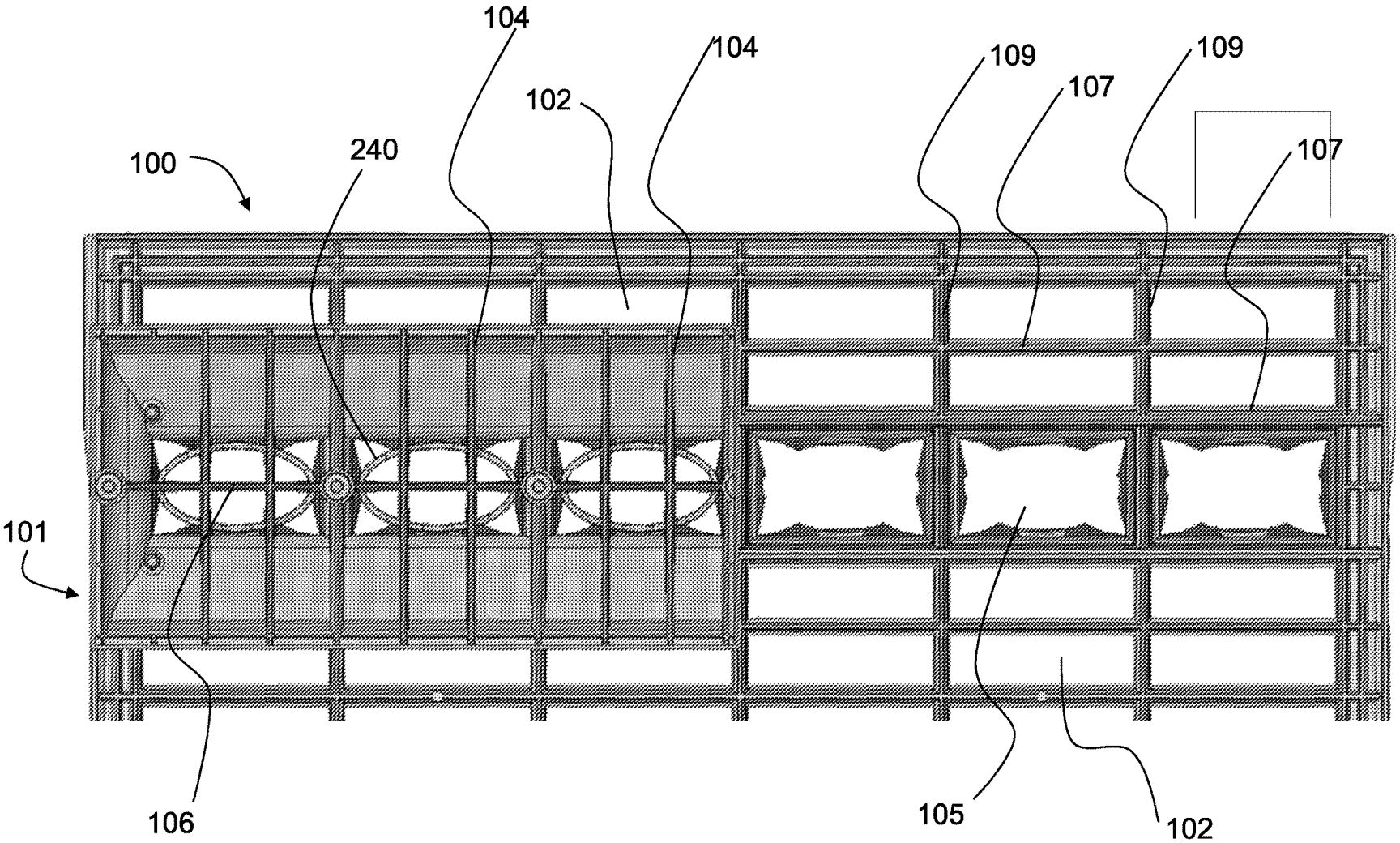
FIG. 9 shows a top view of a portion of a screen frame with a plurality of screen inserts installed in accordance with one or more embodiments of the present disclosure.

In some embodiments, the screen insert unit 101 may include a plurality of longitudinal ribs 104 and one or more transverse ribs 106 defining individual sections of the screen insert unit 101. A screen insert unit 101 may have a single section, two sections, three sections, four sections, or more, depending on the application the screen insert. The longitudinal and transverse ribs 104, 106 of the screen insert unit 101 may provide structural stability to the screen insert unit 101 and/or to a screen mesh disposed on top of the screen insert unit 101. A top surface of the screen insert unit 101 may have a rectangular surface area. The top surface area of the screen insert unit 101 may be based on the shape of the screen frame 100. A screen insert unit 101 may have a single lower portion or insert portion 150, two lower portions or insert portions, three lower portions or insert portions, four lower portions or insert portions, or more, depending on the application of the screen insert unit 101. In certain embodiments, and as shown in the figures, a lower portion 150 of the screen insert unit 101 may be generally square-shaped or rectangular-shaped to fit within a generally rectangular or square opening 105 of the screen frame 100. In other embodiments, the lower portion 150 of the screen insert unit 101 may have a cross-sectional shape which corresponds with the cross-sectional shape of the opening 105 in the screen frame 100, including but not limited to circular, oval, triangular, and other known shapes. The screen insert units 101 may be inserted in one or more openings 105 of the screen frame, such that the screen insert unit 101 extends upward from a top surface of the screen frame 100 to provide an additional screening surface. Thus, each screen insert unit 101 includes an insert portion or lower portion 150 and a screening portion or upper portion 140. In some embodiments, the screen insert unit 101 will have a plurality of insert portions or lower portions 150 corresponding to a number of openings 105 of the screen frame 100. For example, in one embodiment, as shown in FIG. 1, the screen insert unit 101 may have four insert portions or lower portions 150 to be inserted into four corresponding openings 105. In another embodiment, as shown in FIG. 9, the screen insert unit 101 may have three insert portions or lower portions 150 to be inserted into three corresponding openings 105. In other embodiments, any number of insert portions or lower portions 150 may be included in the screen insert unit 101, such as for example, two, four, or more. The number of insert portions or lower portions 150 in a modular screen insert unit may depend on, for example, the size of the screen 100, the number of openings 105, and/or a desired screening area for a particular screen.

In some embodiments, the shape and size of each of the openings 105 defined by the plurality of transverse ribs 107 and longitudinal ribs 109 may be the same. In other embodiments, the shape and size of each of the openings 105 may vary. For example, in some embodiments, one or more openings 105*a* may be configured such that the shape and size of the opening 105*a* corresponds to a configuration (e.g., shape and size) of an insert portion 150 of a screen insert unit 101. One or more other openings 105*b* of the screen frame may have a configuration different from the openings 105*a* configured to receive an insert portion 150 of a modular screen insert unit 101. In this embodiment, the one or more other openings 105*b* may be configured to allow material to pass from an upper surface to a bottom surface of the screen 100 during processing of a material, but may not be configured to receive a modular screen insert unit 101. Various configurations of openings 105*a* configured to receive a modular screen insert unit 101 are discussed in more detail below.

As shown in FIG. 1, for example, a screen frame 100 in accordance with some embodiments of the present disclosure includes a first row of openings 105*a* configured to receive one or more screen insert units 101 and second row of openings 105*c* configured to receive one or more screen insert units 101, with one or more rows of openings 105*b* configured to allow material to pass from an upper surface to a bottom surface, but without modular screen insert units 101 inserted therein. One of ordinary skill in the art will appreciate that various configurations of openings 105 configured to receive a screen insert unit and openings configured to allow material to pass therethrough without a screen insert unit disposed therein may be used without departing from the scope of embodiments herein. For example, a screen frame 100 may include three rows of screen insert units 101, as shown in FIG. 1. The screen insert units 101 may be disposed in one or more openings 105*a* configured to receive screen insert units. One, two, three, or more rows of openings 105*b* that are not configured to receive a screen insert unit may be disposed between rows of the openings 105*a* configured to receive screen insert units. In still other embodiments, all openings 105 of a screen frame 100 may be configured to receive one or more screen insert units. In this embodiment, screen inert units may be disposed in all screen openings 105*a* or in a select number of openings.

Each opening 105 of the screen frame 100 is defined by a portion of a first longitudinal rib 109*a*, a portion of a second longitudinal rib 109*b* (adjacent the first longitudinal rib 109*a* in the plurality of longitudinal ribs), a portion of a first transverse rib 107*a*, and a portion of a second transverse rib 107*b* (adjacent the first transverse rib 107*a* in the plurality of transverse ribs). As noted above, one or more openings 105 are configured to receive an insert portion 150 of a screen insert unit 101. Specifically, the first and second longitudinal ribs 109*a,b* and first and second transverse ribs 107*a,b*, which define the opening 105*a*, may be configured to correspond to a mating surface or surfaces of the insert portion 150 of the screen insert unit 101. For example, the first and second longitudinal ribs 109*a,b* and first and second transverse ribs 107*a,b* may each include a feature or profile (e.g., an arrangement of surfaces, vertical, horizontal, sloped, notched, etc.) configured to collectively provide a seat 125 configured to receive and seal against the screen insert unit 101. Examples of such features or profiles are described in detail below.

For example, as shown in FIGS. 2 and 3, in an opening 105*a* configured to receive a screen insert unit 101, the first longitudinal rib 109*a* of the screen frame 100 may include a sloped first side surface 120 extending downwardly from a top surface 122 of the longitudinal rib 109*a* (which forms part of a top surface of screen frame 100) to a first sealing surface 124. The first sealing surface 124 extends inward from the sloped first side surface 120 towards the opening 105*a* to a first inner surface 126 of the first longitudinal rib 109*a*. Thus, as shown in FIG. 3, the first sealing surface 124 may be oriented in a generally horizontal position and the first inner surface 126 may be oriented in a generally vertical position. In some embodiments, the first sealing surface 124 may include a longitudinal groove 128. The longitudinal groove 128 may be an upward facing groove configured to receive, locate, and facilitate securement of the screen insert 110 within the screen frame 100. The longitudinal groove 128 may also aid in sealing against fluid flow between the screen insert unit 101 and screen frame 100, i.e., to reduce or prevent fluid bypass of the screen insert unit 101. In some embodiments, the longitudinal groove 128 may be defined by opposing tapered surfaces. For example, as shown, the opposing tapered surfaces of the longitudinal groove 128 may form a v-shaped notch. However, one of ordinary skill in the art will appreciate that other shapes of longitudinal grooves may be used, for example, rounded, squared, w-shaped, etc.

The second longitudinal rib 109*b* may include a second side surface 130 opposite the sloped first side surface 120 of the first longitudinal rib 109*a*. In opening 105*a* configured to receive a screen insert unit 101, the second side surface 130 extends downwardly from the top surface 122 of the second longitudinal rib 109*b* (which forms part of a top surface of screen frame 100) to a second sealing surface 134. The second side surface 130 may be substantially vertical or may include a slope (not shown). The second sealing surface 134 extends from the second side surface 130 towards the opening 105*a* to a second inner surface 136 of the second longitudinal rib 109*b*. The second sealing surface 134 may be oriented in a generally horizontal position and the second inner surface 136 may be oriented in a generally vertical position. Similar to the first sealing surface 124, the second sealing surface 134 may include a longitudinal groove 138. The longitudinal groove 138 may be an upward facing groove configured to receive, locate, and facilitate securement of the screen insert 110 within the screen frame 100. The longitudinal groove 138 may also aid in sealing against fluid flow between the screen insert 110 and screen frame 100, i.e., to reduce or prevent fluid bypass of the screen insert. In some embodiments, the longitudinal groove 138 may be defined by opposing tapered surfaces. For example, as shown, the longitudinal groove 138 of the second sealing surface 134 may be v-shaped, similar to the longitudinal groove 128 of the first sealing surface 124; however, one of ordinary skill in the art will appreciate that the second sealing surface 134 may have a differently shaped longitudinal groove 138 including, for example, rounded, squared, w-shaped, etc.

As shown in FIG. 2, the longitudinal rib 109*a* having a sloped first side 120 may also include a sloped second side 121 extending downwardly from the top surface 122 opposite the sloped first side 120. The sloped second side 121 may define a portion of an adjacent opening 105. The adjacent opening 105 may or may not be configured to receive a screen insert unit 110. In some embodiments, the longitudinal rib 109*a* having a sloped first side 120 may include a second side that is not sloped (not shown). In other words, the second side of the longitudinal rib 109*a* may include a second side that extends vertically from the top surface 122. As shown in FIGS. 1-3, the screen 100 may include one or more longitudinal ribs 109*a* having sloped first and second sides 120, 121 and one or more longitudinal ribs 109*b* having generally vertically disposed first and second sides. In some embodiments, the sloped sided longitudinal ribs 109*a* may be alternatingly disposed between non-sloped (vertically disposed) sided longitudinal ribs 109*b*. Thus, as shown, each opening 105 may include one or more sloped surfaces, regardless of whether the opening 105 is configured to receive a screen insert unit 101.

Figure 4:
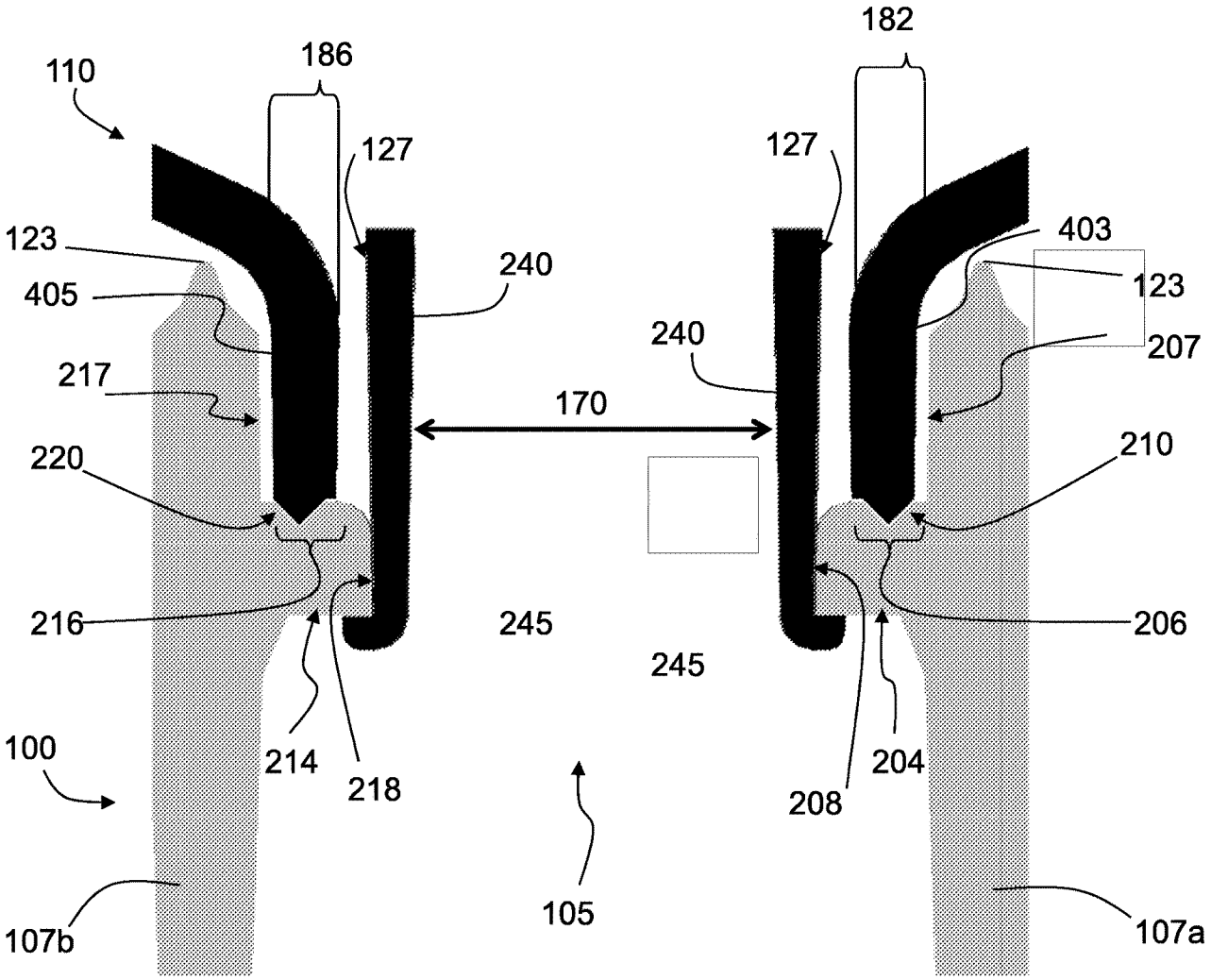
FIG. 4, taken along lines 4-4 of FIG. 2, shows a cross-sectional side view from a transverse side of a portion of a screen frame with a screen insert installed in accordance with one or more embodiments of the present disclosure.

Turning now to FIG. 4, which is a cross-sectional side view taken along lines 4-4 of FIG. 2, a transverse side of a portion of the screen frame 100 with a screen insert 110 installed in accordance with one or more embodiments of the present disclosure is shown. In an opening 105*a* configured to receive screen insert unit 101, the first transverse rib 107*a* includes a third side surface 207 extending downwardly from the top surface 123 of the first transverse rib 107*a* (which forms part of a top surface of screen frame 100) to a third sealing surface 206. The third sealing surface 206 extends inward from the third side surface 207 towards the opening 105*a* to a third inner surface 208 of the first transverse rib 107*a*. Thus, as shown in FIG. 4, the third sealing surface 206 may be oriented in a generally horizontal position and the third inner surface 208 may be oriented in a generally vertical position. A first bottom surface 204 extends from the third inner surface 208 towards the first transverse rib 107*a*. In some embodiments, the third sealing surface 206 includes a longitudinal groove 210, similar to the first and second sealing surfaces (124 and 134). The longitudinal groove 210 may be an upward facing groove configured to receive, locate, and facilitate securement of the screen insert unit 101 within the screen frame 100. The longitudinal groove 210 may also aid in sealing against fluid flow between the screen insert unit 101 and screen frame 100, i.e., to reduce or prevent fluid bypass of the screen insert unit 101. In some embodiments, the longitudinal groove 210 may be defined by opposing tapered surfaces. For example, as shown, the opposing tapered surfaces of the longitudinal groove 210 may form a v-shaped notch. However, one of ordinary skill in the art will appreciate that other shapes of longitudinal grooves may be used, for example, rounded, squared, w-shaped, etc.

In opening 105*a* configured to receive screen insert unit 101, the second transverse rib 107*b* includes a fourth side surface 217 extending downwardly from the top surface 123 (which forms part of a top surface of screen frame 100) to a fourth sealing surface 216. The fourth sealing surface 216 extends inward from the fourth side surface 217 towards the opening 105*a* to a fourth inner surface 218 of the second transverse rib 107*b*. Thus, as shown in FIG. 4, the fourth sealing surface 216 may be oriented in a generally horizontal position and the fourth inner surface 218 may be oriented in a generally vertical position. A second bottom surface 214 extends from the fourth inner surface 218 towards the second transverse rib 107*b*. In some embodiments, the fourth sealing surface 216 includes a longitudinal groove 220 similar to the first, second, and third sealing surfaces (124, 134, and 206). The longitudinal groove 220 may be an upward facing groove configured to receive, locate, and facilitate securement of the screen insert unit 101 within the screen frame 100. The longitudinal groove 220 may also aid in sealing against fluid flow between the screen insert unit 101 and screen frame 100, i.e., to reduce or prevent fluid bypass of the screen insert unit 101. In some embodiments, the longitudinal groove 220 may be defined by opposing tapered surfaces. For example, as shown, the opposing tapered surfaces of the longitudinal groove 220 may form a v-shaped notch. However, one of ordinary skill in the art will appreciate that other shapes of longitudinal grooves may be used, for example, rounded, squared, w-shaped, etc.

Figure 5:
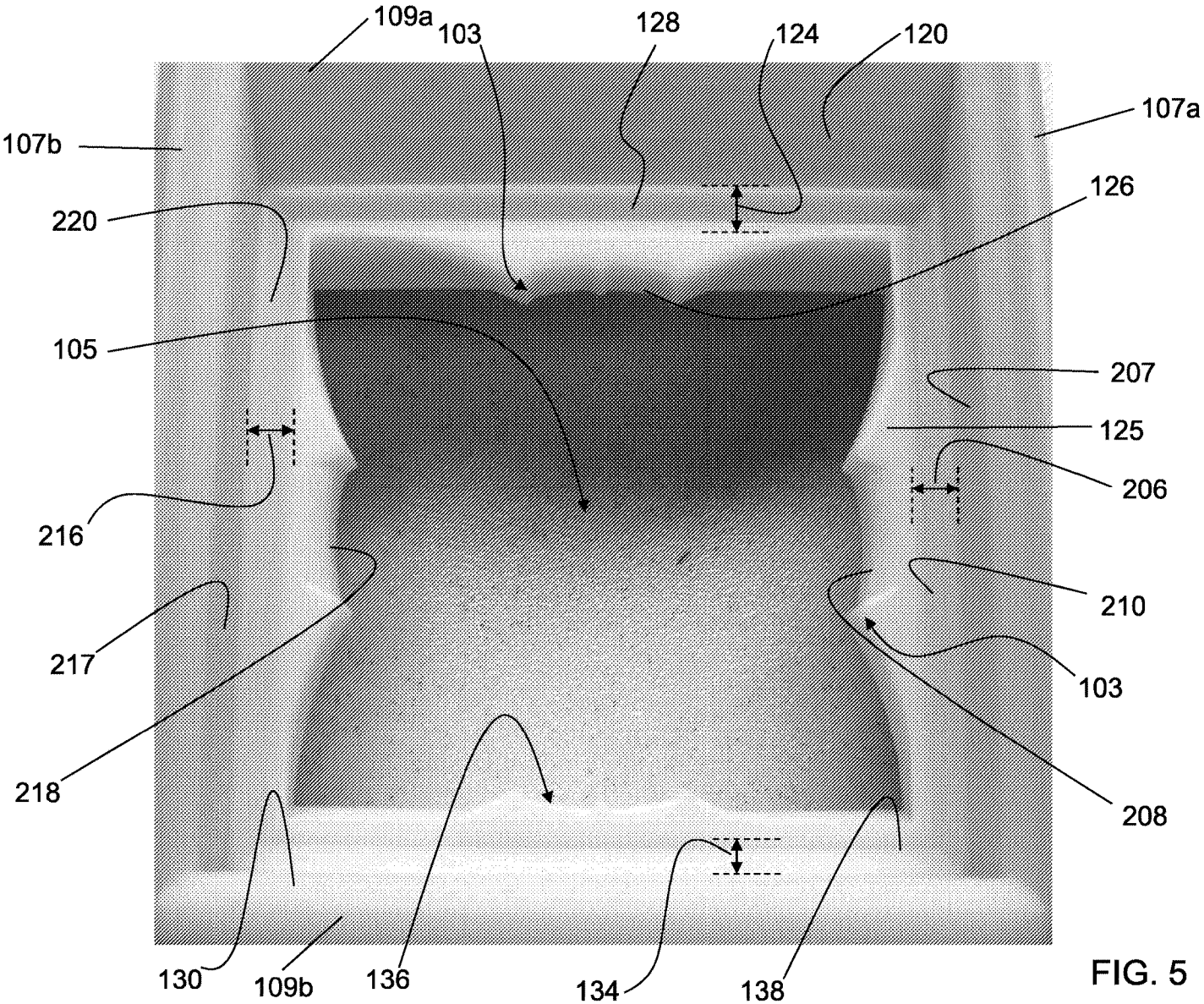
FIG. 5 shows a top perspective view of a portion of a screen frame in accordance with one or more embodiments of the present disclosure.

As shown in FIG. 5, the first sealing surface 124 of the first longitudinal rib 109*a*, the second sealing surface 134 of the second longitudinal rib 109*b*, the third sealing surface 206 of the first transverse rib 107*a*, and the fourth sealing surface 216 of the second transverse rib 107*b* collectively form the seat 125 configured to receive the screen insert unit 101. Further, the longitudinal grooves 128, 138, 210, and 220 may collectively locate and facilitate securement of the screen insert unit 101, and reduce or prevent fluid bypass of the screen insert unit 101.

The inner surfaces 126, 136, 208, and 218 may be curvilinear in shape. For example, the first inner surface 126 protrudes outwardly towards opening 105 with ends tapering back towards the first side surface 120. Such a curvilinear shape may allow for a wider, and thus strengthened, inner surface while still maximizing the opening 105 for fluid flow therethrough. In some embodiments, the inner surfaces 126, 136, 208, and 218 may extend straight towards their respective side surface. For example, the first inner surface 126 may protrude outwardly towards opening 105 and extend straight back towards the first side surface 120. Thus, while examples are shown in drawings and discussed herein, one of ordinary skill in the art will appreciate that other shaped longitudinal ribs and transverse ribs may be used without departing from the scope of embodiments disclosed herein.

Figure 6:
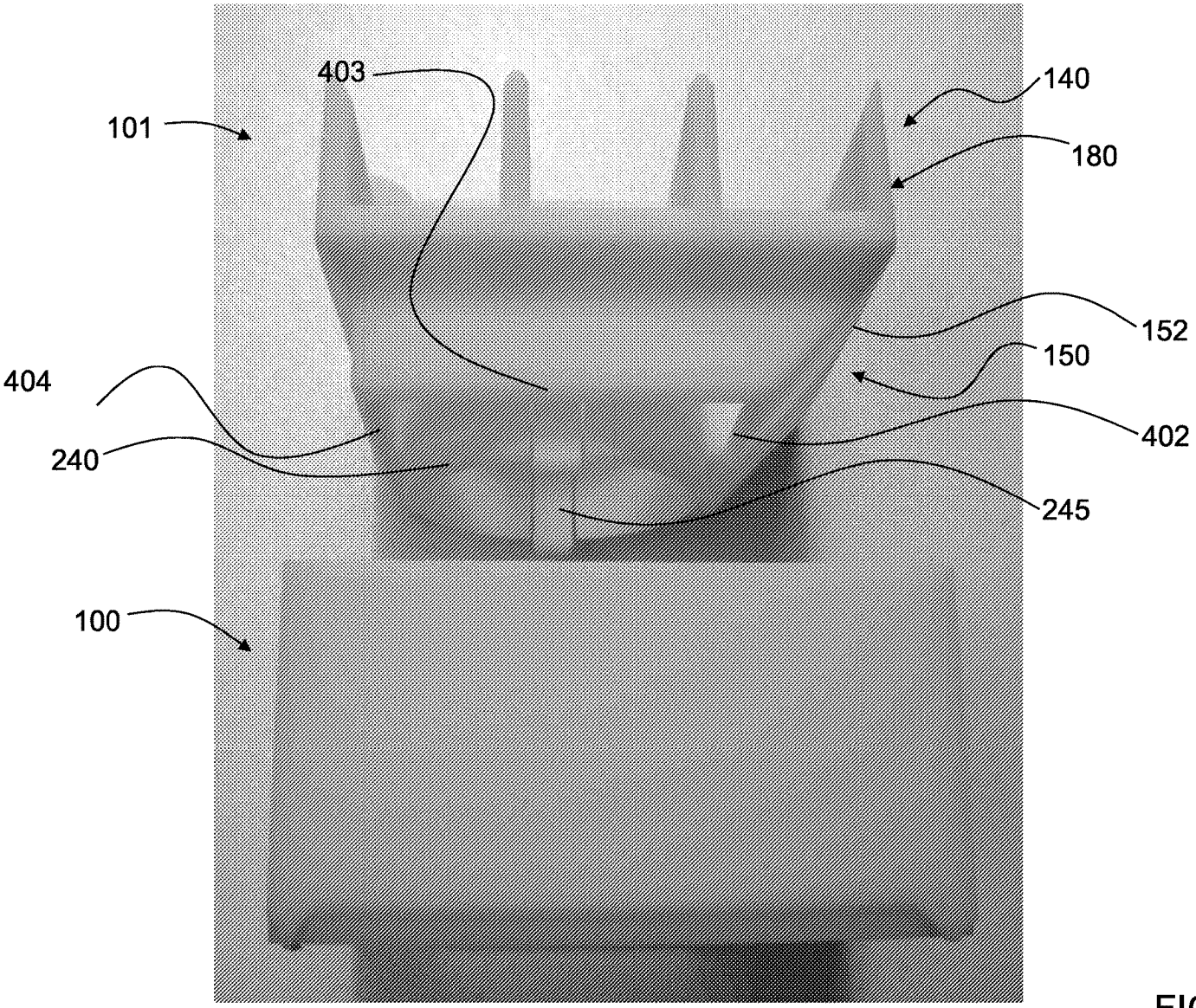
FIG. 6 shows side perspective view of a screen insert prior to installation in a section of a screen frame in accordance with one or more embodiments of the present disclosure.
Figure 7:
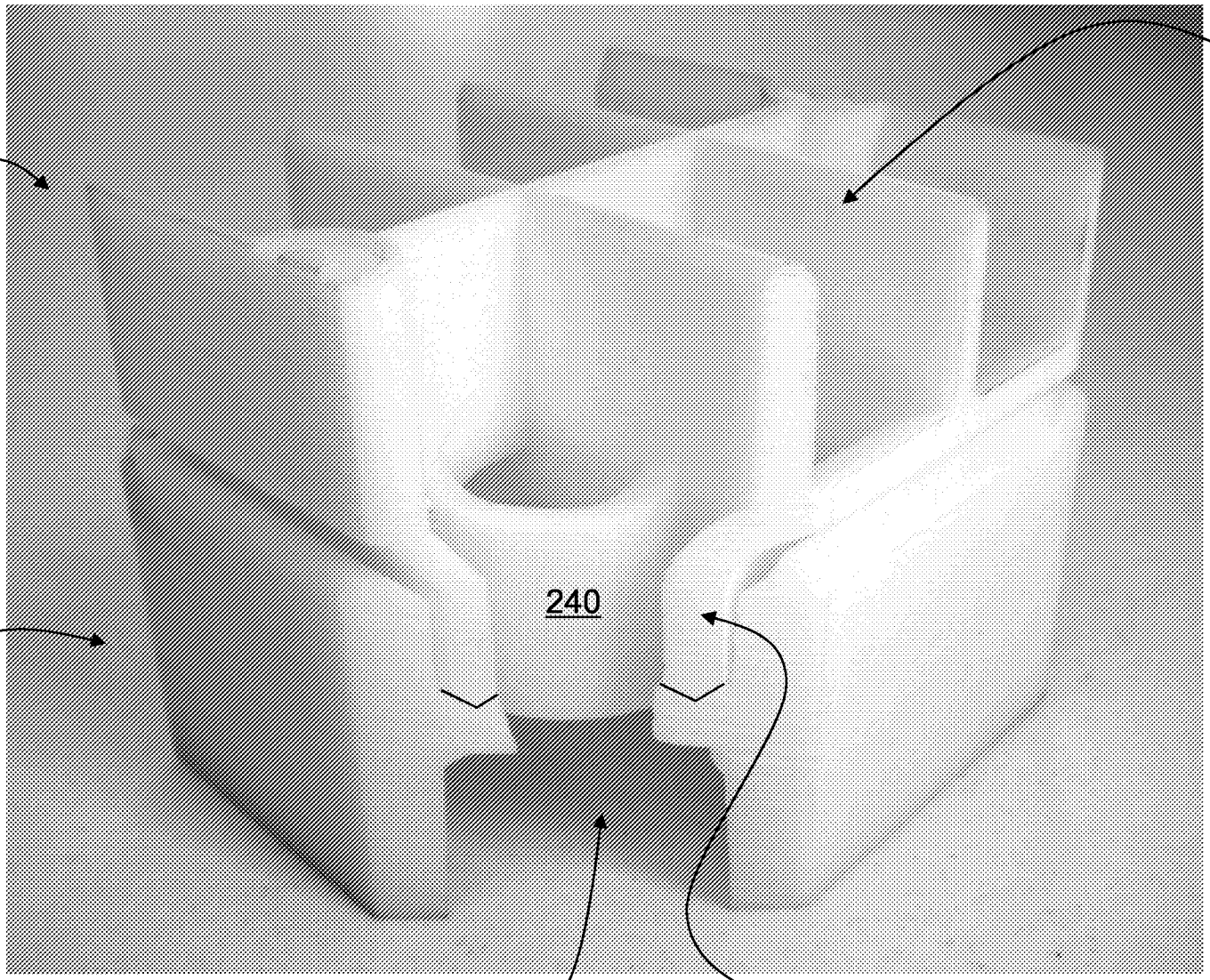
FIG. 7 shows a perspective view of a section of a screen frame with a screen insert installed in accordance with one or more embodiments of the present disclosure.

The lower portion 150 of the screen insert unit 101 may be configured to engage with the features and/or profiles of the first and second longitudinal ribs 109*a,b* and first and second transverse ribs 107*a,b*. For example, with reference to FIGS. 3, 4, and 6, the lower portion 150 of the screen insert unit 101 has a first side 402, a second side 404, a third side 403, and a fourth side 405 which define an opening 170. The screen insert unit 101 may also include an extending member 240 extending downwardly from a lower surface of the screen insert unit 101. As shown in FIGS. 3 and 4, the extending member 240 may extend downwardly from the longitudinal ribs 104 and the transverse ribs (106, FIG. 2) of the upper portion 140 of the screen insert unit 101. The extending member 240 may be formed integrally with the screen insert unit 101 or attached to the longitudinal ribs 104 and the transverse ribs 106 of the screen insert unit 101 using methods well known in the art. The extending member 240 is substantially vertical and configured to engage one or more surfaces of the transverse ribs 107 and longitudinal ribs 109 of the screen 100, as discussed below. Engagement of the extending member 240 of the screen insert unit 101 may be accomplished with an interference fit to secure the screen insert unit 101 with the screen frame 100. Referring again to FIG. 3, the extending member 240 may be configured to engage at least one of the first inner surface 126 of the first longitudinal rib 109*a* and the second inner surface 136 of the second longitudinal rib 109*b*. The extending member 240 may be hollow to allow filtered fluid flow through the screen insert unit 101. The extending member 240 may be cylindrical (as shown in FIGS. 2 and 6, oval (as shown in FIG. 9), square, rectangular, or any other shape without departing from the scope of embodiments disclosed herein.

As shown in FIG. 3, the first side 402 of the screen insert unit 101 also includes a sloped first side surface 152 that extends inwardly towards the opening 170 from a lower surface of the screen insert unit 101 or a first outer surface 180 of the screen insert unit 101 to a first mating surface 154. The first mating surface 154 extends from the sloped first side surface 152 inwards towards the opening 170 to an outer surface 127 of the extending member 240. As shown, in some embodiments, the first mating surface 154 may be oriented in a generally horizontal position while the outer surface 127 of the extending member may be oriented in a generally vertical position. The sloped first side surface 152 of the screen insert 110 is configured to engage the sloped first side surface 120 of the first longitudinal rib 109*a*, the first mating surface 154 is configured to contact the first sealing surface 124 of the first longitudinal rib 109*a*, and the first inner surface 126 of the first longitudinal rib 109*a* is configured to contact the outer surface 127 of the extending member 240. While the first mating surface 154 is shown to engage the groove 128 of the first sealing surface 124, in other embodiments, the groove 128 may be formed in the first mating surface 154 and the first sealing surface 124 of the first longitudinal rib 109*a* would be configured to contact the groove 128.

The second side 404 includes a second side surface 156 of the screen insert unit 101 that extends downwardly from a lower surface of the screen insert unit 101 or a second outer surface 190 of the screen insert unit 101 to a second mating surface 158. The second mating surface 158 extends from the second side surface 156 inwards towards the opening 170 to an outer surface 127 of the extending member 240. As shown, in some embodiments, the second mating surface 158 may be oriented in a generally horizontal position while the outer surface 127 of the extending member may be oriented in a generally vertical position. The second side surface 156 of the screen insert unit 101 is configured to engage the second side surface 130 of the second longitudinal rib 109*b*, the second mating surface 158 is configured to contact the second sealing surface 134 of the second longitudinal rib 109*b*, and the second inner surface 136 of the second longitudinal rib 109*b* is configured to contact the outer surface 127 of the extending member 240. While the second mating surface 158 is shown to engage the groove 138 of the second sealing surface 134, in other embodiments, the groove 138 may be formed in the second mating surface 158 and the second sealing surface 134 of the second longitudinal rib 109*b* would be configured to contact the groove 138.

Figure 10:
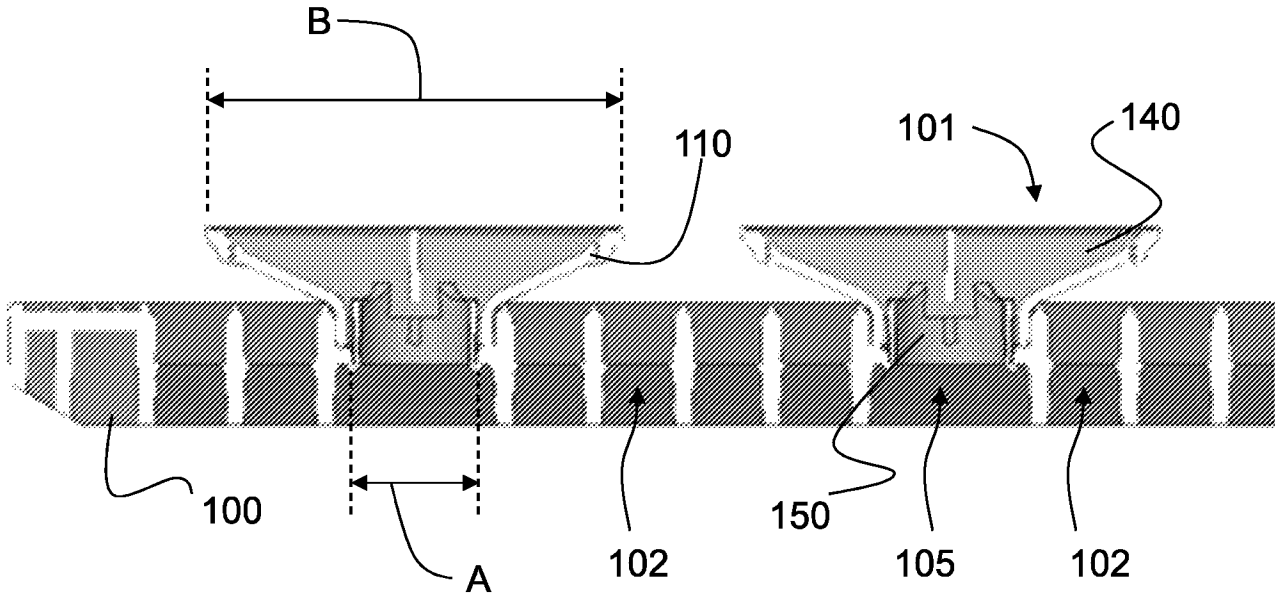
FIG. 10, taken along lines 7-7 of FIG. 1, shows a cross-sectional side view from a transverse side of a screen frame with a plurality of screen inserts installed in accordance with one or more embodiments of the present disclosure.

As shown in FIG. 4 and FIG. 10, which is a cross-sectional side view from a transverse side of the screen frame 100 taken along lines 10-10 of FIG. 1, the third side 403 of screen insert unit 101 includes a third side surface 181 that extends downwardly from a lower surface of the screen insert unit 101 or a first outer surface 180 of the screen insert unit 101 to a third mating surface 182. The third mating surface 182 extends from the third side surface 181 inwards towards the opening 170 to an outer surface 127 of the extending member 240. As shown, in some embodiments, the third mating surface 182 may be oriented in a generally horizontal position while the outer surface 127 of the extending member may be oriented in a generally vertical position. The third side surface 181 of the screen insert unit 101 is configured to engage the third side surface 207 of the first transverse rib 107*a*, the third mating surface 182 is configured to contact the third sealing surface 206 of the first transverse rib 107*a*, and the third inner surface 208 of the first transverse rib 107*a* is configured to contact the outer surface 127 of the extending member 240. Similarly, the fourth side 405 of screen insert unit 101 includes a fourth side surface 185 that extends downwardly from a lower surface of the screen insert unit 101 or a first outer surface 180 of the screen insert unit 101 to a fourth mating surface 186. The fourth mating surface 186 extends from the fourth side surface 185 inwards towards the opening 170 to an outer surface 127 of the extending member 240. As shown, in some embodiments, the fourth mating surface 186 may be oriented in a generally horizontal position while the outer surface 127 of the extending member may be oriented in a generally vertical position. The fourth side surface 185 of the screen insert unit 101 is configured to engage the fourth side surface 217 of the second transverse rib 107*b*, the fourth mating surface 186 is configured to contact the fourth sealing surface 216 of the second transverse rib 107*b*, and the fourth inner surface 218 of the second transverse rib 107*b* is configured to contact the outer surface 127 of the extending member 240.

As shown in FIG. 10, the lower portion 150 of the screen insert unit 101 has a cross-section that corresponds with the cross-section of the opening 105 into which the screen insert unit 101 will be installed. The lower portion 150 has a width "A." The upper portion 140 has a width "B" which is greater than width "A", thereby providing a generally Y-shaped cross section configuration of the screen insert unit 101. The width "B" may be about twice that of width "A" or even greater in certain embodiments, thereby increasing the screening area of the screen insert unit 101 and providing the potential for higher effective fluid processing capacity of the screen frame 100. In other embodiments, the upper portion 140 of the screen insert 110 may have a T-shaped, U-shaped, W-shaped, or other shape cross-sectional configuration.

FIG. 6 shows a portion of a prototype of the screen insert unit 101 to be installed in an opening (not shown) of a section of screen frame 100. The screen insert unit 101 is located over the screen frame 100 opening to be installed into. The longitudinal and transverse side surfaces and sealing surfaces of the screen frame are located and matched to the corresponding longitudinal and transverse side surfaces and sealing surfaces of the screen insert unit 101, as previously discussed with respect to FIGS. 3 and 4. The sealing surfaces of the screen frame and screen insert unit are located properly when the opposing tapered surfaces of the screen insert unit fit the corresponding longitudinal grooves of the screen frame. The screen insert unit is urged downwardly into the screen frame until the side surfaces and sealing surfaces of the screen frame mate with the corresponding side surfaces and sealing surfaces of the screen insert unit, as previously discussed with respect to FIGS. 3 and 4.

The sloped first side surface (not shown) of the frame 100 is configured to engage a corresponding sloped first side surface 152 of a lower portion 150 of the screen insert, creating an in-situ sealing mechanism after some time of apparatus operation when sediment and small solids in the fluid flow create a filter-cake in the space between the sloped first side surface 120 and the corresponding sloped first side surface 152 and thus block unwanted fluid flow between the screen insert unit and screen frame. Additionally, the sloped first side surface 120 is intended to aid the location of the screen insert unit into the screen frame during assembly.

Figure 8:
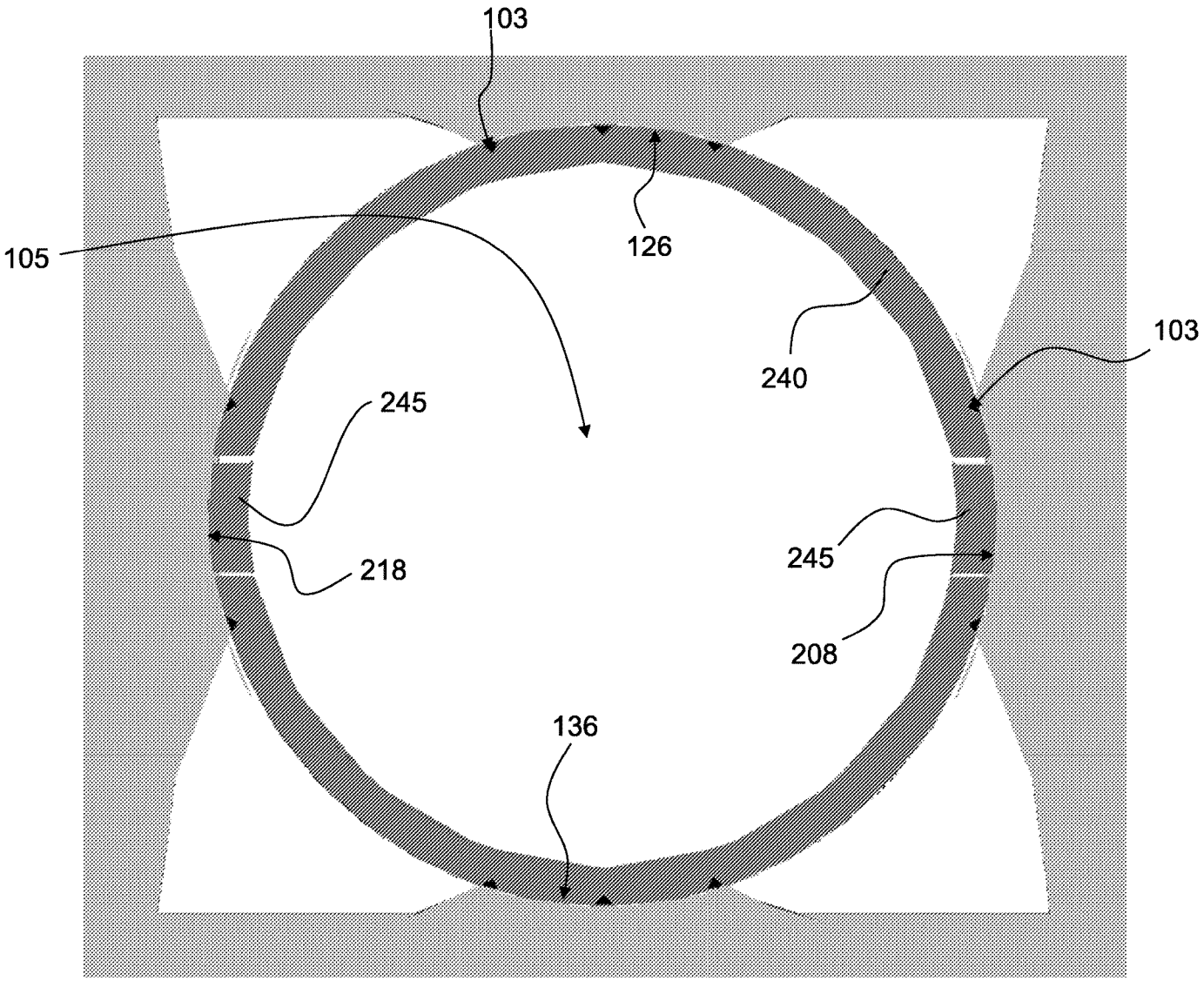
FIG. 8 shows a cross-sectional view of a portion of a screen frame with a screen insert installed in accordance with one or more embodiments of the present disclosure.

Referring now to FIGS. 4 and 8, in some embodiments, the extending member 240 may include at least one outwardly extending clip 245 at a distal end of the extending member 240. The at least one clip 245 may be formed integrally with the extending member 240 or attached to the extending member 240 using methods well known in the art. The at least one clip 245 extends outwardly and is configured to engage at least one of first bottom surface 204 of the first transverse rib 107*a* and the second bottom surface 214 of the second transverse rib 107*b*. The at least one clip 245 may aid in securing the screen insert unit 101 to a screen frame 100. FIG. 4 illustrates the extending member 240 having two outwardly extending clips 245, each on opposite sides of the extending member 240 from the other. However, one of ordinary skill in the art will appreciate that more than two outwardly extending clips 245 may be included in the extending member 240. Further, one of ordinary skill in the art will appreciate that other features may be used to engage at least one of the first bottom surface 204 of the first transverse rib 107*a* and the second bottom surface 214 of the second transverse rib 107*b*. For example, rather than clips, the distal end of the extending member 240 may include an outwardly extending, elastically deformable lip to engage at least one of the first bottom surface 204 of the first transverse rib 107*a* and the second bottom surface 214 of the second transverse rib 107*b* and further secure the screen insert unit 101 with the screen frame 100.

As shown in FIGS. 5 and 8, the first inner surface 126 of the first longitudinal rib 109*a*, the second inner surface 136 of the second longitudinal rib 109*b*, the third inner surface 208 of the first transverse rib 107*a*, and the fourth inner surface 218 of the second transverse rib 107*b* are configured to engage the extending member 240. In some embodiments, the extending member may be cylindrical, however, one of ordinary skill in the art will appreciate that other shapes of extending members may be used. The extending member 240 may include two outwardly extending clips 245, each 180 degrees from the other as shown in FIG. 8, or four or more outwardly extending clips 245 configured to engage a bottom surface of at least one of the first inner surface 126 of the first longitudinal rib 109*a*, the second inner surface 136 of the second longitudinal rib 109*b*, the third inner surface 208 of the first transverse rib 107*a*, and the fourth inner surface 218 of the second transverse rib 107*b*.

A slight pressure may be applied while urging the screen insert unit 101 into the screen frame 100 to engage the extending member 240 with at least one of the first inner surface 126 of the first longitudinal rib 109*a*, the second inner surface 136 of the second longitudinal rib 109*b*, the third inner surface 208 of the first transverse rib 107*a*, and the fourth inner surface 218 of the second transverse rib 107*b*, having an interference fit therebetween, and to engage the outwardly facing clips 245 with a bottom surface of at least one of the first inner surface 126 of the first longitudinal rib 109*a*, the second inner surface 136 of the second longitudinal rib 109*b*, the third inner surface 208 of the first transverse rib 107*a*, and the fourth inner surface 218 of the second transverse rib 107*b*.

Further, as shown in FIG. 8, at least one of the first inner surface 126 of the first longitudinal rib 109*a*, the second inner surface 136 of the second longitudinal rib 109*b*, the third inner surface 208 of the first transverse rib 107*a*, and the fourth inner surface 218 of the second transverse rib 107*b* may include a plurality of teeth 103. The plurality of teeth 103 are configured to grip an outer surface of the extending member 240 to further aid in securing the screen insert unit 101 with the screen frame 100. The plurality of teeth 103 may include teeth having planar ends and/or non-planar ends. Further, the plurality of teeth 103 may be integrally formed with the inner surfaces thereof or may be fastened to the inner surfaces in a number of ways including using fasteners, adhesives, and other known attachment methods.

FIG. 10 shows a prototype of an individual screen insert 110 installed in an opening 105 of a section of screen frame 100. One of ordinary skill in the art will appreciate that the screen insert unit may be welded with the screen frame to provide additional security of the connection between the screen frame and the screen insert. For example, the longitudinal and transverse side surfaces and sealing surfaces of the screen frame may be ultrasonic welded with the longitudinal and transverse side surfaces and sealing surfaces of the screen insert unit. Further, the inner surfaces of the longitudinal and transverse ribs may be ultrasonically welded to the extending member. As shown in FIG. 10, the extending member 240 is accessible from the top and bottom ends of the screen frame 100.

While the description above provides various examples of features and profiles of a screen insert unit coupled to a screen, one of ordinary skill in the art will appreciate that various modifications to various features and profiles may be used to secure an insert to a screen and aid in providing a seal between the screen insert unit and the screen to prevent fluid bypass of the screen insert unit without departing from the scope of embodiments disclosed herein. For example, one of ordinary skill in the art will appreciate that the angle of the sloped first side surface 120 and the angle of the corresponding sloped first side surface 152 may vary depending on, for example, the desired screening surface area of the screen insert 110, the width of an upper portion 140 of the screen insert 110, the width of the lower portion 150 of the screen insert 110, the width of the opening 105, the desired or expected flow rate of material to be separated, etc. In this embodiment, the sloped first side surface 120 and the corresponding sloped first side surface 152 have the same angle. The angle of the sloped first side surface 120 and the corresponding sloped first side surface 152 may be between, for example, 10 degrees and 80 degrees. In some embodiments, the angle of the sloped first side surface 120 and the corresponding sloped first side surface 152 may be between 30 degrees and 60 degrees. In yet other embodiments, the angle of the sloped first side surface 120 and the corresponding sloped first side surface 152 may be between 10 degrees and 50 degrees or between 25 degrees and 75 degrees. One of ordinary skill in the art will appreciate that the sloped first side surface 120 and the corresponding sloped first side surface 152 may be of any degree based on a given application. A plurality of screen inserts in a modular unit may have the same or varying angles of the sloped first side surface 120 and the corresponding sloped first side surface 152 between each of the plurality of screen inserts in the modular unit. The sloped first side surface 120 and the corresponding sloped first side surface 152 need not have the exact same angle in certain embodiments.

Further, the screen insert units 101 may be made of any material suitable for a particular application, e.g., oilfield screens, wastewater treatment screens, food processing screens, etc. For example, glass-filled polypropylene may be used in certain embodiments. In other embodiments, glass-filled nylon may be used. Steel reinforcements may also be used inside the screen insert units 101 to add rigidity. The screen insert units 101 may be integrally molded inserts or assembled insert components.

Additionally, a mesh screen (not shown) may be applied to the top of the screen insert unit 110. The mesh screen may have any sized apertures as will be appreciated by one having ordinary skill in the art. As an embodiment, the mesh screen may have mesh that is rectangular, square or oblong in shape. The mesh may be interlocking or calendared or may have a design to increase fluid flow with respect to a similar sized mesh. The mesh screen may be secured to the screen insert unit 101 prior to the screen insert unit 101 being inserted into the openings 105 of the screen frame 100. Alternatively, the screen insert unit 101 may have mesh applied prior to being inserted into the openings 105 of the screen frame 100. The mesh screen may be fastened to the screen insert unit in a number of ways including using fasteners, adhesives, and other known attachment methods. For example, in the case of a composite material, the mesh screen may be secured to the screen frame 100 by melting the composite material to secure the screen frame 100 to the mesh screen. A mesh screen may also be applied to the top of the screen frame 100 over cells 102 and openings 105 which do not include a screen insert unit 101.

The mesh screen size (i.e., the mesh spacing) may be determined by characteristics of the particular fluid and/or particulate matter to be processed. For example, in a wellbore application, the mesh screen size may be determined by characteristics of a particular wellbore. For example, depending on the wellbore characteristics, a coarse mesh screen may be used for drilling a wellbore containing, for example, mostly gumbo (e.g., soft, sticky, swelling clay or sticky shale) and a fine mesh screen may be used for drilling a wellbore containing, for example, higher sand content. In other embodiments, different mesh sizes (i.e., mesh screen having different size openings) may be used on different surfaces of the same screen. For example, a first mesh screen size may be used to cover the screen insert unit 101 and a second mesh screen size may be used to cover the openings 105 and cells 102 which do not include a screen insert unit 101. In other embodiments, a first mesh screen size may be used to cover an area of the screening surface nearest a proximate end of the shaker and a second mesh screen size may be used to cover an area of the screening surface nearest a distal end of the shaker.

Vibratory separators using conventional filtering screens may be retrofitted with high capacity filtering screens (screens and/or screen insert units) as described herein to reduce assembly time and effort. For example, conventional filtering screens, using gaskets for sealing against unwanted fluid flow between the components and requiring fittings for securing the components together, may be retrofitted with high capacity filtering screens as described herein.

Although only a few example embodiments have been described in detail above those skilled in the art will readily appreciate that many modifications are possible in the example embodiments without materially departing from scope of the present application. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. An apparatus comprising:

a screen frame including:

a plurality of transverse ribs and a plurality of longitudinal ribs defining a plurality of openings therebetween;

a first longitudinal rib of the plurality of longitudinal ribs having a sloped first side surface, the sloped first side surface extending downwardly from a top surface of the first longitudinal rib to a first sealing surface, the first sealing surface extending to a first inner surface of the first longitudinal rib, the first sealing surface including a longitudinal groove defined by opposing tapered surfaces; and a second longitudinal rib of the plurality of longitudinal ribs having a second side surface opposite the sloped first side surface of the first longitudinal rib, the second side surface extending downwardly from a top surface of the second longitudinal rib to a second sealing surface, the second sealing surface extending to a second inner surface of the second longitudinal rib, the second sealing surface including a longitudinal groove defined by opposing tapered surfaces; and a screen insert configured to be disposed in an opening of the plurality of openings.

2. The apparatus of claim 1, wherein the screen insert comprises:

an upper portion having a screening surface; and a lower portion for insertion into the opening, the lower portion including:

a corresponding sloped first side surface configured to engage the sloped first side surface of the first longitudinal rib, the corresponding sloped first side surface extending downwardly to a corresponding first sealing surface having two opposing tapered surfaces configured to engage the opposing tapered surfaces of the first sealing surface of the first longitudinal rib; and a corresponding second side surface configured to engage the second side surface of the second longitudinal rib, the corresponding second side surface extending downwardly to a corresponding second sealing surface having two opposing tapered surfaces configured to engage the opposing tapered surface of the second sealing surface of the second longitudinal rib.

3. The apparatus of claim 1, wherein a first transverse rib of the plurality of transverse ribs having a third side surface, the third side surface extending downwardly from a top surface of the first transverse rib to a third sealing surface, the third sealing surface extending to a third inner surface of the first transverse rib, the third sealing surface including a longitudinal groove defined by opposing tapered surfaces, and a second transverse rib of the plurality of transverse ribs having a fourth side surface opposite the third side surface of the first transverse rib, the fourth side surface extending downwardly from a top surface of the second transverse rib to a fourth sealing surface, the fourth sealing surface extending to a fourth inner surface of the second transverse rib, the fourth sealing surface including a longitudinal groove defined by opposing tapered surfaces.

4. The apparatus of claim 3, wherein the lower portion further comprises an extending member extending downwardly and configured to engage the first inner surface of the first longitudinal rib and the second inner surface of the second longitudinal rib.

5. The apparatus of claim 4, wherein the extending member further comprises at least one outwardly extending clip configured to engage a bottom surface adjacent to at least one of the third inner surface of the first transverse rib and the fourth inner surface of the second transverse rib.

6. The apparatus of claim 4, wherein the first inner surface of the first longitudinal rib and the second inner surface of the second longitudinal rib further comprises a plurality of teeth configured to grip an outer surface of the extending member.

7. The apparatus of claim 3, wherein at least one of the first longitudinal rib, the second longitudinal rib, the first transverse rib, and the second transverse rib are curvilinear in shape and having a protruding middle section tapering towards at least one of the first side surface, the second side surface, the third side surface, and the fourth side surface.

8. The apparatus of claim 4, wherein the extending member is cylindrical in shape.

9. The apparatus of claim 4, wherein the extending member is oval in shape.

* * * * *